United States Patent [19]

Isoda

[11] Patent Number: 5,000,604

[45] Date of Patent: Mar. 19, 1991

[54] REMOVABLE CAP ATTACHED TO A WRITING INSTRUMENT

[75] Inventor: Takashi Isoda, Kanagawa, Japan

[73] Assignee: Mitsubishi Pencil Co., Ltd., Japan

[21] Appl. No.: 416,462

[22] Filed: Oct. 3, 1989

[51] Int. Cl.[5] ..... B43K 5/00

[52] U.S. Cl. ..... 401/202; 401/213; 401/243

[58] Field of Search ..... 401/202, 213, 243; D19/57

[56] References Cited

U.S. PATENT DOCUMENTS

| | | | |
|---|---|---|---|
| 4,844,642 | 7/1989 | Inaba et al. | 401/202 |
| 4,915,529 | 4/1990 | List | 401/202 |

FOREIGN PATENT DOCUMENTS

| | | | |
|---|---|---|---|
| 319311 | 6/1989 | European Pat. Off. . | |
| 2174374 | 11/1986 | United Kingdom | 401/243 |
| 2215279 | 9/1989 | United Kingdom . | |

*Primary Examiner*—Richard J. Apley

*Assistant Examiner*—D. F. Crosby

*Attorney, Agent, or Firm*—James A. Wong

[57] ABSTRACT

A removable cap attached to a writing instrument in an insertion manner for preventing ink from evaporating from the writing instrument, comprises: a partially double-walled cylindrical cap main body having its opposite axial ends opened and its rear portion double-walled to form an inner cylindrical wall and an outer cylindrical wall, the inner cylindrical wall being provided with a plurality of axial slits defining a plurality of axial lands therebetween; and a cylindrical inner cap for hermetically covering a pen-point portion of the writing instrument, the cylindrical inner cap having its front axial end opened and its rear axial end closed, the cylindrical inner cap being supported by the axial lands of the inner cylindrical wall of the cap main body so as to leave rear-end portions of the axial slits of the inner cylindrical wall of the cap main body open, through which rear-end portions of the axial slits the interior of the cap main body communicates with open air.

1 Claim, 2 Drawing Sheets

REMOVABLE CAP ATTACHED TO A WRITING INSTRUMENT

BACKGROUND OF THE INVENTION

1. Field of the Invention

The present invention relates to an improvement of a removable cap attached, in an insertion manner, to a front-end portion of a writing instrument such as marking pens, markers and the like so as to prevent ink from evaporating from the writing instrument.

2. Description of the Prior Art

Removable caps attached to the writin instruments such as marking pens, markers and the like are employed to prevent ink from evaporating from the writing instruments, to protect pen-point portions of the writing instruments from damages and to prevent the writing instruments from smudging other items with ink thereof. Consequently, the caps are constructed of resin-molded articles which are excellent in properties of preventing ink from evaporating from the writing instruments. For example, as shown in FIGS. 5 to 8, a conventional removable cap 12 attached to a writing instrument in an insertion manner is provided with an axial bore 15 in which an inner cylindrical portion 13 is integrally formed with a rear-end wall portion or closed end portion of the cap 12 a front end of which is open. Since the conventional cap 12 having the above construction is completely closed at its rear end, there is a fear that the cap suffocates infant's bronchi when the infant swallows the cap whole.

SUMMARY OF THE INVENTION

It is an object of the present invention to provide an improved removable cap attached to a writing instrument, which cap can prevent ink from evaporating from the writing instrument as is in the case of the conventional cap and is provided with an axial ventilating means for ventilating an axial bore of the cap itself, the means being able to prevent an infant from being choked by the cap when the infant swallows the cap whole.

The above object of the present invention is accomplished by providing:

A removable cap attached to a writing instrument in an insertion manner for preventing ink from evaporating from the writing instrument, comprising:

A partially double-walled cylindrical cap main body having its opposite axial ends opened and its rear portion double-walled to form an inner cylindrical wall and an outer cylindrical wall, the inner cylindrical wall being provided with a plurality of axial slits defining a plurality of axial lands therebetween; and A cylindrical inner cap for hermetically covering a pen-point portion of the writing instrument, the cylindrical inner cap having its front axial end opened and its rear axial end closed, the cylindrical inner cap being supported by the axial lands of the inner cylindrical wall of the cap main body so as to leave rear-end portions of the axial slits of the inner cylindrical wall of the cap main body open, through which rear-end portions of the axial slits the interior of the cap main body communicates with open air.

DESCRIPTION OF THE PREFERRED EMBODIMENTS

Figure 1:
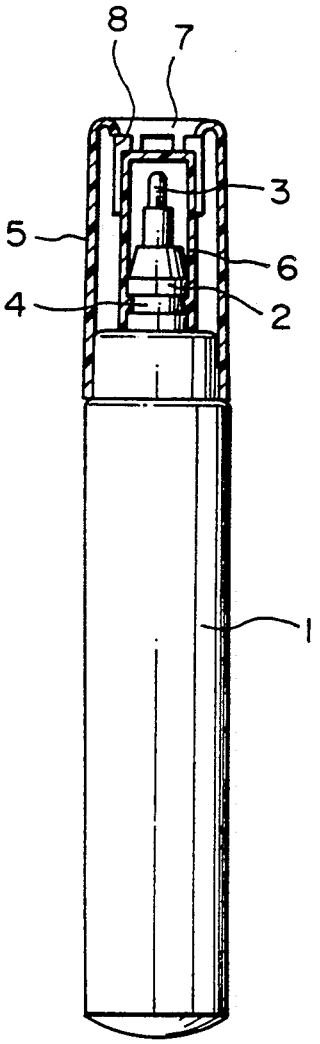
FIG. 1 is a longitudinal sectional view of an embodiment of a removable cap of the present invention attached to a writing instrument in an insertion invention attached to a writing instrument in an insertion manner.
Figure 2:
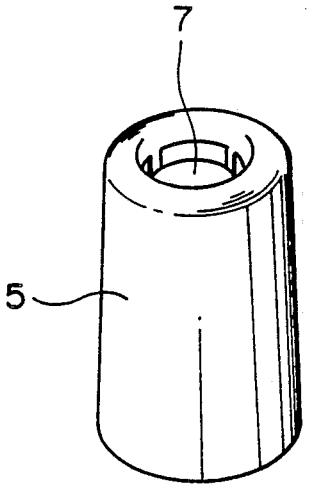
FIG. 2 is a perspective view of the cap of the present invention shown in FIG. 1.

The present invention will be described hereinbelow, by way of example, in detail with reference to the accompanying drawings. Since many changes and modifications can be made to the following construction without departing from the scope of the present invention, it is intended that all matters given in the following description and illustrated in the accompanying drawings shall be interpreted to be illustrative only and not as a limitation to the scope of the present invention.

FIGS. 1 to 4 show an embodiment of a removable cap of the present invention attached to a marking pen 1 in an insertion manner, in which: the reference numeral 5 denotes a cylindrical cap main body of the removable cap of the present invention. The cap main body 5 assumes a cylindrcal form having its opposite axial ends open to form an axial bore 11 having a rear-end opening 7 and a front-end opening in which is inserted a font-end portion of the marking pen 1.

Figure 3:
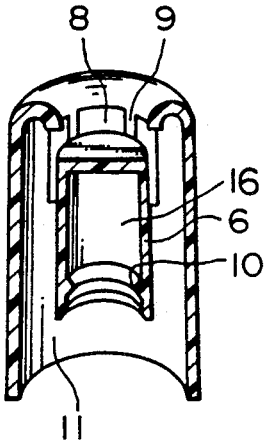
FIG. 3 is a partially broken perspective view of the cap of the present invention shown in FIG. 1, illustrating the longitudinal sectional view of the cap of the present invention.
Figure 4:
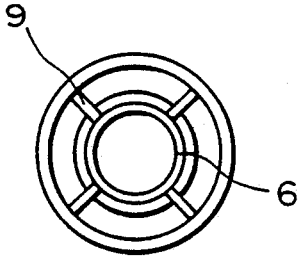
FIG. 4 is a bottom view of the cap of the present invention shown in FIG. 1.
Figure 5:
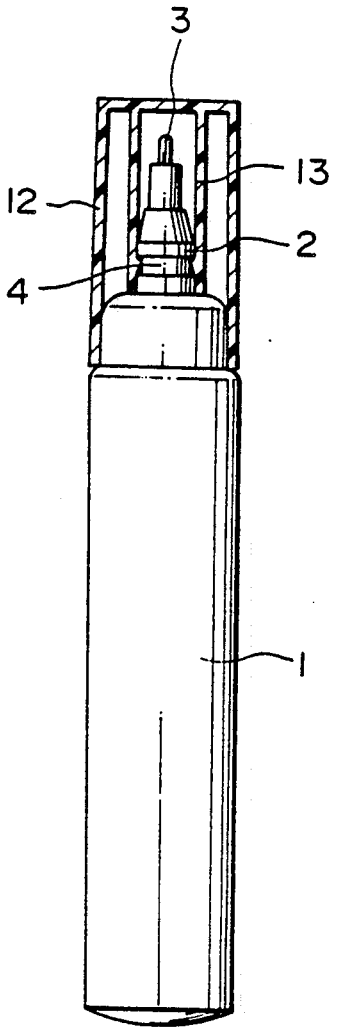
FIG. 5 (PRIOR ART)
FIG. 5 is a longitudinal sectional view of a conventional removable cap attached to a writing instrument.
Figure 6:
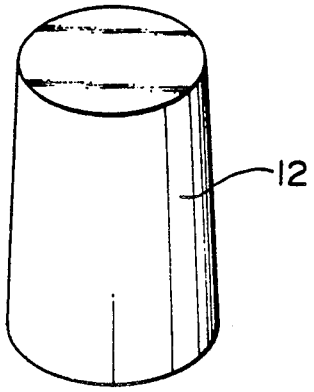
FIG. 6 (PRIOR ART)
FIG. 6 is a perspective view of the conventional cap shown in FIG. 5.
Figure 7:
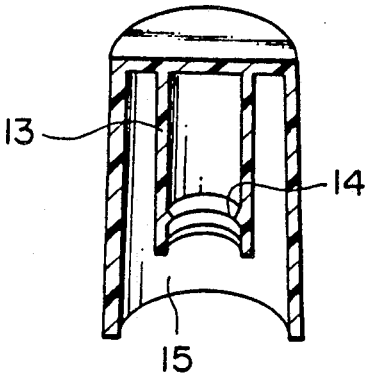
FIG. 7 (PRIOR ART)
FIG. 7 is a partially broken perspective view of the conventional cap shown in FIG. 5, illustrating the longitudinal sectional view of the conventional cap.
Figure 8:
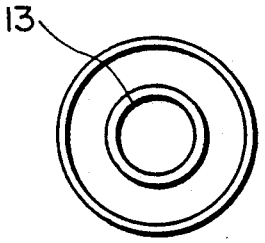
FIG. 8 (PRIOR ART)
FIG. 8 is a bottom view of the conventional cap shown in FIG. 5.

A rear-end portion of the cap main body 5 is double-walled to form a cylindrical inner wall and a cylindrical outer wall, which inner wall defines the rear-end opening 7 which is smaller in diameter than the front-end opening or axial bore 11 of the cap main body 5 as is clear from FIG. 3. From a front-end portion of the cylindrical inner wall of the cap main body 5, a plurality of axial slits 8 extend rearward to define a plurality of axial lands 9 therebetween. In the embodiment of the cap of the present invention shown in FIGS. 1 to 4, the number of the axial lands 9 of the cylindrical inner wall of the cap main body 5 is four. However, the number of the axial lands 9 is not limited to four.

As is clear from FIG. 3, a cylindrical inner cap 6 having its rear end closed and its front end opened is coaxially mounted in the cap main body 5, i.e., the inner cap 6 is supported by the axial lands 9 of the inner wall of the cap main body 5 to leave rear-end portions of the axial slits 8 of the inner wall of the cap main body 5 open, the slits 8 being defined between the axial lands 9, whereby the interior or axial bore 11 of the cap main body 5 communicates with open air even when the front-end opening of the cap main body 5 is closed with the pen-point portion 2 of the marking pen 1 during non-use of the pen 1.

The inner cap 6 of the cap of the present invention is provided with an axial central bore 16 which hermetically receives the pen-point portion 2 of the marking pen 1 therein to prevent ink from evaporating from the marking pen 1.

In an inner peripheral surface of a front-end portion of the inner cap 6 is formed an annular ridge 10 which engages, during non-use of the pen 1, with an annular groove 4 formed in an outer peripheral surface of the pen-point portion 2 of the marking pen 1.

Since the cap of the present invention has the above construction, as shown in FIG. 1, when the pen-point portion 2 of the marking pen 1 is covered with the cap of the present invention during non-use of the pen 1, the annular ridge 10 of the inner wall of the cap main body 5 hermetically engages with the annular groove 4 of the pen-point portion 2 of the pen 1 to prevent the ink from evaporating from the marking pen 1.

When the cap of the present invention is detached from the marking pen 1, the axial flow of air is realized over the full length of the interior of the cap of the present invention through the axial bore 11, axial slits 8 and the rear-end opening 7 of the cap of the present invention.

Consequently, even if the infant swallows the cap of the present invention whole, since the cap of the present invention is provided with an axial ventilating means enabling the infant to inhale and exhale air freely, there is no fear that the infant is choked by the cap. In addition, the cap of the present invention is excellent in appearance and properties of preventing the ink from evaporating from the writing instrument.

What is claimed is;

1. A removable cap attached to a writing instrument in an insertion manner for preventing ink from evaporating from the writing instrument, comprising:

a partially double-walled cylindrical cap main body having its opposite axial ends opened and its rear portion double-walled to form an inner cylindrical wall and an outer cylindrical wall, said inner cylindrical wall being provided with a plurality of axial slits defining a plurality of axial lands therebetween; and a cylindrical inner cap for hermetically covering a pen-point portion of the writing instrument, and cylindrical inner cap having its front axial end opened and its rear axial and closed, said cylindrical inner cap being supported by said axial lands of said inner cylindrical wall of said cap main body so as to leave rear-end portions of said axial slits of said inner cylindrical wall of said cap main body open, through which rear-end portions of said axial slits the interior of said cap main body communicates with open air.

* * * * *